United States Patent [19]

Matsuda et al.

[11] 4,083,763

[45] Apr. 11, 1978

[54] METHOD FOR MANUFACTURING COLORED METAL SHEETS

[75] Inventors: Shozo Matsuda, Nishi; Naoe Hirai, Kitakyushu; Tadashi Tanaka, Yokohama, all of Japan

[73] Assignee: Nippon Steel Corporation, Tokyo, Japan

[21] Appl. No.: 647,172

[22] Filed: Jan. 7, 1976

Related U.S. Application Data

[63] Continuation-in-part of Ser. No. 364,336, May 29, 1973, abandoned, which is a continuation of Ser. No. 839,982, Jul. 8, 1969, abandoned.

[30] Foreign Application Priority Data

Jul. 8, 1968 Japan ..... 43-48011

[51] Int. Cl.[2] ..... C25D 13/06; C25D 13/16

[52] U.S. Cl. ..... 204/181 E

[58] Field of Search ..... 204/181

[56] References Cited

U.S. PATENT DOCUMENTS

| | | | |
|---|---|---|---|
| 3,290,235 | 12/1966 | Gilchrist | 204/181 |
| 3,663,383 | 5/1972 | Matsuda et al. | 204/181 |
| 3,679,572 | 7/1972 | Smith et al. | 204/181 |

*Primary Examiner*—Howard S. Williams

*Attorney, Agent, or Firm*—Wenderoth, Lind & Ponack

[57] ABSTRACT

A method for manufacturing colored metal sheet or coil at a high speed according to the principle of a two coating- one baking method, in which a primer coat is formed at a high speed by an electrodepositing coating and a final coat is formed by the painting of a finishing paint, which is polymerizable by electron beams and then the coated metal sheet or coil is subjected to an electron beaming, whereby a colored metal sheet having two coatings which are hardened by electron beams and excellent in anticorrosiveness and workability may be obtained at a high speed.

6 Claims, 1 Drawing Figure

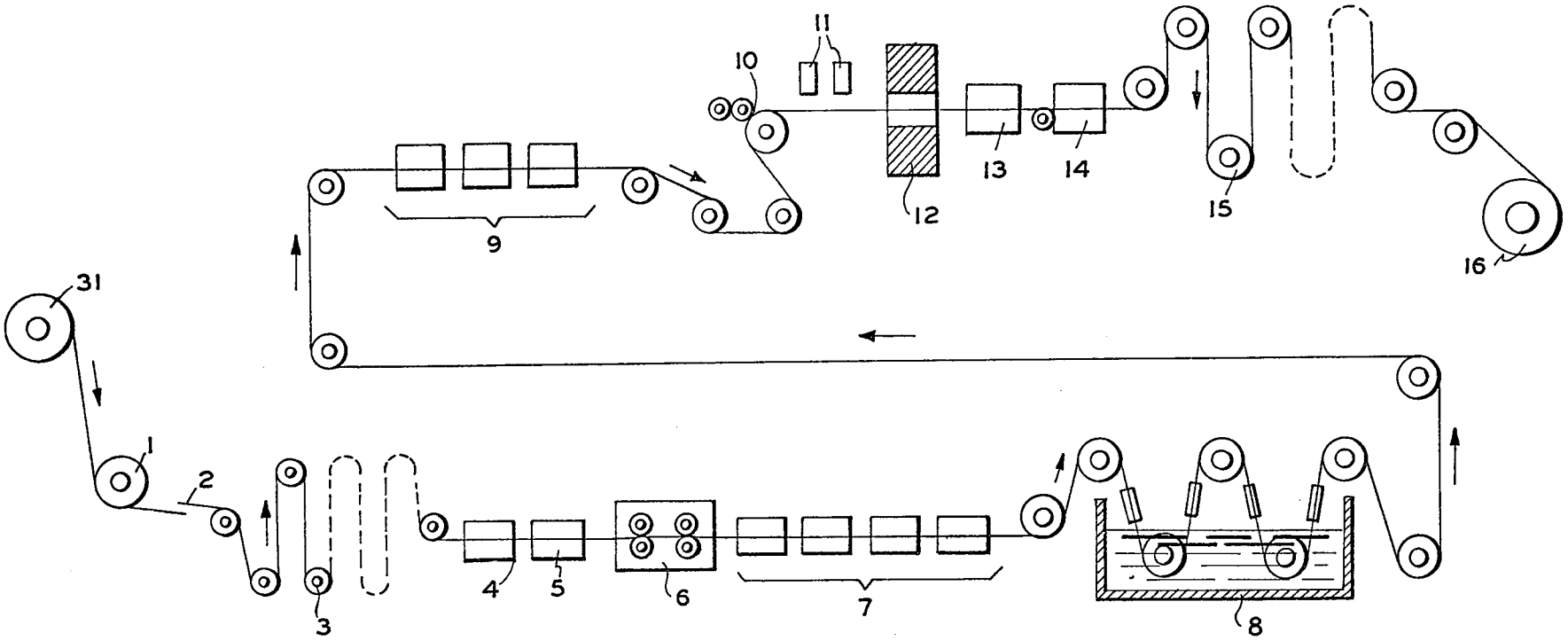
31
1
2
3
4
5
6
7
8
9
10
11
12
13
14
15
16

METHOD FOR MANUFACTURING COLORED METAL SHEETS

CROSS-REFERENCE TO RELATED APPLICATIONS

The present application is a continuation-in-part of Ser. No. 364,336, filed May 29, 1973, which in turn is a continuation of Ser. No. 839,982, filed July 8, 1969, now abandoned.

BACKGROUND OF THE INVENTION

The present invention relates to a method for manufacturing a colored or non-colored metal sheet or coil.

The production of colored metal sheets has grown increasingly in recent years. For example, galvanized steel sheets coated with color paints have already reached half the whole demand for galvanized steel sheets in Japan. Steel sheets coated with color paint immediately on the surface thereof and steel sheets coated with aluminum containing colored paints on the surface of the aluminum are also increasing in production. As to materials to be coated, not only metal materials themselves, but also surface-coated materials of various kinds are painted and put to practical use. With an increase in the production of such colored metal sheets, great progress in technical studies and research has been made with the result that remarkable improvements in various techniques have been achieved. For instance, improvements have been made in the area of double-coatings with color paints, an increase in the coating thickness, an increase in the amount of zinc platings and improvements in the quality of colored coatings. Further, there have also been developed, improvements such as foamed coating, embossing and texturing methods and the like in the colored coating area. However, in the face of qualitative and quantative improvements of colored coatings, as mentioned above, there has been developed a keen imbalance between the technical improvements and methods of elevating the production line speed during the production of such colored coatings.

The present invention is an epochal method of solving the above-mentioned problem and is considered to represent a quite novel and practical method of overcoming this difficulty.

DESCRIPTION OF THE PRIOR ART

The present invention is an improvement of the invention made by the same inventors of the present invention disclosed in patent applications having the title of "Method for manufacturing painted metal sheet" filed in various countries (U.S. patent application No. 734,801, British patent application No. 26,696, German patent application No. P 1771 533.2, Belgian patent application No. 48,012 and Australian patent application No. 38,805), characterized by a "two coating — one baking" method. The improvement disclosed in the present application resides in employing a second coating or paint on the steel sheet which may be subsequently polymerized with electron beams, and then subjecting the said coating to an electron beaming, thereby causing the polymerization reaction of the coating. As the line speed can be tremendously speeded up by the method of the present invention, the total length of the line may be remarkably shortened and moreover a color coat having excellent properties may be obtained.

Heretofore, various endeavors have been made, dating way back, to speed up the line speed in the method of producing colored coatings on metal sheets. The problem has been approached by attempting to modify the equipment used in the production process as well as by attempting to study the physicochemical properties of the paint used. For instance, in Japan studies have shown that the said speed showed a record of 3 to 5 m.p.m. in 1959, which was later advanced to 10 to 20 m.p.m. and then has attained a maximum of 45 m.p.m. when the production reached the level of 2,000 tons/-month. Since about the end of 1964, the line speed of a color coated steel sheet was about 60 m.p.m. and even as high as 90 m.p.m. in the most developed lines in up-to-date plants. In the ascending tendency of the line speed, as above-mentioned, the last two cases were mainly attributable to the invention disclosed in the above-mentioned patent applications, which will serve also to evidence the practicability of the present invention.

That is to say, the invention disclosed in the above-mentioned patent applications, in which the two coating — one baking method is provided, is itself a very useful process on account of an electrodepositing primer coating of a steel sheet or strip, because the electrodepositing primer coating displays a special effectiveness in the high speed formation of a uniform thin coat, particularly a coat of less than 3 to 8 microns thick and is far superior in many points to the so-called "two coating-two baking" method. However, the said method is attended with the disadvantage of merely speeding up of the line speed in the second coating step, and because an ordinary painting method is carried out in the second coating step, it consequently follows that the whole length of the line is enlarged and cumbersome. Although the total length of the production line has been shortened to some degree by the development of a new heating oven in the United States in recent years, the problem has not yet been fundamentally solved.

Further, as regards the painting process, it is to be noted that in the painting method in which a roll coater is conventionally used, troubles begin to occur when the line speed reaches about 100 m.p.m. and it becomes very difficult to raise the line speed up to 200 to 500 m.p.m. In this respect, a painting method in which a flow coater is used, as employed on wood and plywood at the present time, is more suitable for raising the line speed and is considered to be the most suitable method for speeding up the production line speed of colored steel sheets in the future. On the other hand, however, when combining the latter method with the two coating method, there will be involved various difficult problems due to the differences between the qualities of a paint required for use in the painting by means of a flow coater (such as the uniformity of the coating, the smoothness of the coated surface and the like) and the qualities of a paint required for use in the double painting.

SUMMARY OF THE INVENTION

The paints to be electrodeposited in the first coating operation of the present invention are water-soluble or water-dispersable resins which do not contain polymerizable unsaturated carbon bonds (—C=C—), active to electron beams. Examples of such resins suitable in the method of the present invention may be found in French Pat. No. 717,106 to Yawata Iron and Steel Co., Ltd, i.e. acrylic ester copolymer resins, phenol resins, epoxide resins, alkyd resins, etc. Similarly, there can be used any of the conventionally used water-soluble or water-dispersable paints which do not contain said polymerizable unsaturated carbon bonds in their structure as well as various paints made of known water-soluble aqueous emulsions of various kinds satisfying the above definition.

As to the electrodepositing treating bath, the following may be cited as an example thereof: the bath is made of a water-soluble treating solution consisting of two main components; the one is a water-soluble resin composed mainly of lower grade alkyl esters of acrylic acid and/or lower grade alkyl esters of methacrylic acid resins and ammonium or amine salts thereof, and the other is a water-soluble hexavalent chromium compound added in an amount of 0.01 to 5.0 wt.% of the above mentioned resin.

In the finishing coating step, according to the present invention, a flow coater is particularly adapted to the ultra high line speed as above mentioned. Also, a roll coater may be used, but the use thereof is, of course, restricted to the cases of the medium and low line speeds. Further, in the present invention, a dipping method or an air wiping method may also be adopted as the finishing coating process.

Thus, the present invention is an improvement over the previously mentioned invention relating to the "two-coating-one baking method" for which patent applications have been filed and which methods are practical working methods. According to the present invention, the line speed is greatly accelerated while strictly retaining the advantages of the said two coating-one baking method, in which an electrodepositing primer coating is applied. More particularly, the present method comprises the steps of subjecting a metal sheet or coil, pretreated for painting, to an electrodepositing painting to form a primer coat on the surface of the metal sheet or the coil, then immediately coating the metal sheet or the coil with a finishing paint, which is polymerizable with electron beams, without interposing a baking between the electrodepositing coating and the finishing coating, but after drying the primer coat and then electron-beaming the thus-coated metal sheet or coil to form a coat polymerized with electron beams.

According to the method of the present invention, it is for the first time possible to produce a two coating colored metal sheet at a high speed by combining the electrodepositing coating and the electron beaming polymerization steps. As a line speed exceeding 200 to 300 m.p.m. can be easily obtained according to the method of the present invention, it is also possible to incorporate the method of the present invention in the existing high speed plating system. In this respect, the present invention can be said to be of epoch proportions also in the aspect of the line equipment.

Viewed from the above mentioned various conditions, the feature and superiority of the present invention will clearly be understood.

A typical example of the manufacturing process of the present invention shall be given in the following.

The sequence of the steps of the present process is as follows:

Metal sheet → [Surface cleaning step] →

[Pretreating step] → [Electrodepositing step] →

-continued

[Water-washing | Air-drying] → [Finishing painting step] →

[Electron beaming step] → [~~Baking~~] → [Finishing]

DESCRIPTION OF THE DRAWING

An example of a galvanized steel sheet in the process of the present invention shall be explained with reference to the attached drawing showing the process steps of the present invention in sequence.

The above-mentioned process steps show an example of the high speed production line according to the present invention, in which the line speed amounted to about 300 m.p.m.

DESCRIPTION OF THE PREFERRED EMBODIMENTS

After a galvanized steel sheet No. 31 uncoiled by an uncoiler 1 was passed through a welding or stitching apparatus 2 and a front accumulator 3, it was first sprayed with a Pn 362 degreasing solution in a degreasing tank 4 as a surface cleaning step. After being washed with hot water in a hot water washing tank 5 and then being washed with cold water, the steel sheet was ground on the surface with Scoth Bright of brushing rolls 6 so as to make the surface activated. It was again water-washed and then treated with a chemical for phosphate treatment in a chemical treating tank 7 as a pretreating step. After being water-washed and chromate-air dried, the steel sheet entered an electrodepositing tank 8, in which the electrodeposition was carried out at 60 V for about 1.5 seconds by using a perfectly water-soluble resin of ammonium acrylate, acrylic ester and ammonium chromate as an electrdepositing coating bath. A typical electrodepositing bath may be prepared, for example, by diluting 10 parts of a water-soluble solution of copolymer of acrylic acid and an acrylic butyl (mol ratio of 4:6) having an average molecular weight of about 5,000 with 90 parts of water and then adding 0.01 part of ammonium chromate after the pH value of said water-soluble solution has been adjusted to be 6.8 by means of ammonium water. In general, the electrodeposition is preferably carried out at a voltage of less than 100 V in a bath having a temperature of less than 80° C for a period of less than 10 seconds. The electrodeposited amount was about 30 mg/dm$^2$ and the excess solution was immediately squeezed with rolls. After the electrodeposited steel sheet was then water-washed and air-dried in a washing and drying apparatus 9 to perfectly remove water contained in the coat, it was coated with a paint made of acrylic ester by using a curtain flow coater 11 (the numeral 10 in the drawing represents a roll coater). The dry amount of the finishing coat was about 200 mg/dm$^2$. Then, the steel sheet was passed through an infrared ray heating oven, which serves simultaneously as an air blower, in order to expel any flux contained in the coat.

Electron beams were then irradiated from an electron beaming gun of an electron accelerator 12 on the steel sheet through a beam window cell having a width of 3 inches deep, that is, a width in the advancing direction of the steel sheet under irradiating conditions of a generated voltage of 300 KeV, an electric current of 100 mA and a beam density of 1.7 mA/in$^2$, thereby to cause a polymerization due to the irradiation. Then, a heating was applied to the steel sheet for several seconds by a heating apparatus 13 to increase the affinity between the primer coat and the final coat. The steel sheet was then cooled in a cooler 14 and was coiled by a coiler 16 through a rear accumulator 15.

The thus-obtained product having two coats consisting of an electrodeposited undercoat and a final coat, said coats being hardened by electron beams, showed a coat hardness of 3 H and were excellent in anticorrosiveness and workability. As to the weatherproofness, it was proven as a result of a weatherometer test, that after the lapse of more than 1,000 hours, good luster and color have been sufficiently retained.

As is evident from the foregoing, the characteristic features of the present invention have resulted from the combination of high speed formation of a thin and uniform primer coat by the electrodepositing coating and the high speed formation of the final coat polymerized and hardened by the irradiation of electron beams. It is also a great advantage of the present invention that the formation of two coats are electrically operated. That is, as the line operation is carried out by a switch-on-off system, it can be performed in tune with the line speed. Consequently, there occurs no irregularities nor defects in the quality of the final product.

Thus, according to the method of the present invention the line speed can be remarkably increased and at the same time the coating zone can be made extremely short, quite different from any conventional method. From this fact, it may be concluded that in various plating lines which have been heretofore considered not to be adaptable to a two coating system, for instance, in the Sendzimir zinc plating line, the two coating system can be easily adopted.

Further, it is to be noted that after the electron beaming, the product may be subjected to a waxing or printing, depending upon the objects of the product to be used.

As to pigments to be used in manufacturing colored metal sheets there may be used chromates, aluminium silicate, titan white and the like. The pigment is added mainly to the paint to be used in the primer coating. It may be also added to the paint to be used in the finishing coating, but in a small amount, because, otherwise, the polymerization reaction due to electron beams might be unfavorably affected thereby.

As to the metal sheet to be used in the present invention, there may be used not only steel sheets and aluminum sheets, but also plated steel sheets of various kinds, such as steel sheets plated with zinc, aluminum, tin, chromium and nickel.

Phosphate treatment and other chemical treatments are carried out as a pretreating step for the subsequent electrodepositing treatment, but these pretreatments may be omitted according to circumstances.

The finishing paints which are to be polymerized with electron beams are those composed mainly of a monomer or prepolymer containing a beam polymerizable group. In general, they should be the paints which may be polymerized with a radiation absorbed dose of less than 2 Megarad.

Practically, there are used organic solvent-soluble or monomer-soluble type paints containing unsaturated carbon bonds (C=C) active to electron beams. Examples of such paints are paints made of styrene, acryl, methacryl, vinyl acetate series or maleic acid resins. Thus, electron beam-curing paints used on galvanized iron objects sold on the market may be used, for instance, a paint sold under the tradename "Nissan Beam Coat", manufactured by Nippon Oil and Fat Company (Nippon Yushi Co.) may be used.

The electron beaming conditions are influenced by the molecular structure and polymerization characteristics of the paints to be used and the electron beaming gun to be used. However, in general the voltage should be more than 50 KeV and the range of 100 to 300 KeV is optimal. As for the paints for use in the finishing coating, such ones may be used as can be polymerized with a radiation absorbed dose of less than 10 Megarad under the above-mentioned voltage. In the case of a higher voltage than the above-mentioned range, there will occur difficulty in protecting the operators against X-rays and special apparatus must be used. With such paints as can be polymerized first with a radiation absorbed dose of more than 10 Megarad, the essential feature of the present invention of manufacturing a product of high quality at a very high speed must be diminished.

From the viewpoint of the time required for the polymerization of paints, paints are preferred which can be polymerized during a period of less than 2 to 3 seconds.

What is claimed is:

1. A method for manufacturing a colored or non-colored metal coil, comprising the steps of subjecting a metal coil, pretreated for coating, to an electrodepositing coating with a water-soluble or water-dispersable resin which does not contain unsaturated carbon bonds (C=C) polymerizable with electron beams, at a voltage of less than 100 V, for less than 10 seconds, to form a primer coating on the metal coil, water-washing and air-drying the primer coating, them immediately, without curing the primer coating, non-electrolytically coating it with an organic solvent-soluble or monomer-soluble type paint containing unsaturated carbon bonds (C=C) polymerizable with electron beams, as a finishing paint, and then electron beaming it to form a polymerized coating thereon.

2. A method according to claim 1 wherein the coil produced is a colored painted coil.

3. A method according to claim 1 wherein the coil produced is a non-colored painted coil.

4. A method for manufacturing a colored or non-colored metal coil, comprising the steps of subjecting a metal coil, pretreated for coating, to an electrodepositing coating with a water-soluble or water-dispersable resin, which does not contain unsaturated carbon bonds (C=C) polymerizable with electron beams, at a voltage of less than 100 V, for less than 10 seconds, to form a primer coating, on the metal coil, then immediately, without curing the primer coating, non-electrolytically coating it with an organic solvent-soluble or monomer-soluble type paint containing unsaturated carbon bonds (C=C) polymerizable with electron beams, as a finishing paint and then electron beaming it to form a polymerized coating and simultaneously heating and baking it to increase the affinity between the two coats.

5. A method according to claim 4 wherein the coil product is a color painted coil.

6. A method according to claim 4 wherein the coil produced is a non-colored painted coil.

* * * * *